US010260120B2

(12) United States Patent
Swiatek et al.

(10) Patent No.: US 10,260,120 B2
(45) **Date of Patent: *Apr. 16, 2019**

(54) PROCESSES FOR REDUCING FLATNESS DEVIATIONS IN ALLOY ARTICLES

(71) Applicant: ATI Properties LLC, Albany, OR (US)

(72) Inventors: Glenn J. Swiatek, Palos Heights, IL (US); Ronald E. Bailey, Pittsburgh, PA (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/693,527

(22) Filed: Sep. 1, 2017

(65) Prior Publication Data

US 2017/0362673 A1 Dec. 21, 2017

Related U.S. Application Data

(63) Continuation of application No. 12/565,809, filed on Sep. 24, 2009, now Pat. No. 9,822,422.

(51) Int. Cl.
*C21D 8/02* (2006.01)
*C21D 6/00* (2006.01)
(Continued)

(52) U.S. Cl.
CPC ..... *C21D 8/0242* (2013.01); *C21D 6/00* (2013.01); *C21D 7/13* (2013.01); *C21D 9/00* (2013.01);
(Continued)

(58) Field of Classification Search
CPC ..... C21D 8/02; C21D 8/0242; C21D 6/00; C21D 7/13; C21D 9/00; C21D 9/46;
(Continued)

(56) References Cited

U.S. PATENT DOCUMENTS 3,148,093 A 9/1964 Williams et al.
3,423,254 A 1/1969 Safford et al.
(Continued)

FOREIGN PATENT DOCUMENTS

CN 101381854 11/2009
DE 3407959 A1 11/1985
(Continued)

OTHER PUBLICATIONS

ATI Defense, Technical Data Sheet, ATI 600-MIL Ultra High Hard Specialty Steel Armor, Apr. 2, 2009.
(Continued)

*Primary Examiner* — Edward M Johnson
(74) *Attorney, Agent, or Firm* — Robert J. Toth; K&L Gates LLP

(57) ABSTRACT

A process for reducing flatness deviations in an alloy article is disclosed. An alloy article may be heated to a first temperature at least as great as a martensitic transformation start temperature of the alloy. A mechanical force may be applied to the alloy article at the first temperature. The mechanical force may tend to inhibit flatness deviations of a surface of the alloy article. The alloy article may be cooled to a second temperature no greater than a martensitic transformation finish temperature of the alloy. The mechanical force may be maintained on the alloy article during at least a portion of the cooling of the alloy article from the first temperature to the second temperature.

34 Claims, 8 Drawing Sheets

(51) Int. Cl.

| | |
|---|---|
| ***C21D 7/13*** | (2006.01) |
| ***C21D 9/00*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/40*** | (2006.01) |
| ***C22C 38/42*** | (2006.01) |
| ***C22C 38/44*** | (2006.01) |

(52) U.S. Cl.
CPC ..... *C21D 9/46* (2013.01); *C22C 38/02* (2013.01); *C22C 38/04* (2013.01); *C22C 38/06* (2013.01); *C22C 38/18* (2013.01); *C22C 38/40* (2013.01); *C22C 38/42* (2013.01); *C22C 38/44* (2013.01); *C21D 2211/008* (2013.01)

(58) Field of Classification Search
CPC ..... C22C 38/02; C22C 38/04; C22C 38/06; C22C 38/18
USPC ..... 148/645
See application file for complete search history.

(56) References Cited

U.S. PATENT DOCUMENTS

| | | | |
|---|---|---|---|
| 3,466,022 | A | 9/1969 | Rum |
| 4,142,923 | A | 3/1979 | Satava |
| 4,881,392 | A | 11/1989 | Thompson et al. |
| 5,454,883 | A | 10/1995 | Yoshie et al. |
| H001512 | H | 1/1996 | Cowan et al. |
| 5,518,557 | A | 5/1996 | Jones et al. |
| 5,830,293 | A | 11/1998 | Meyer et al. |
| 5,911,844 | A | 6/1999 | Benedyk |
| 6,451,137 | B1 | 9/2002 | Pelissier |
| 2002/0104597 | A1 | 8/2002 | Frank et al. |
| 2002/0157734 | A1 | 10/2002 | Senda et al. |
| 2005/0016643 | A1 | 1/2005 | Mathies et al. |
| 2005/0224129 | A1 | 10/2005 | Raos |
| 2011/0067788 | A1 | 3/2011 | Swiatek et al. |

FOREIGN PATENT DOCUMENTS

| | | | |
|---|---|---|---|
| DE | 102006042569 | B3 | 1/2008 |
| EP | 0481378 | A1 | 4/1992 |
| EP | 1005926 | A2 | 6/2000 |
| GB | 1490535 | | 11/1977 |
| JP | S54-124864 | A | 9/1979 |
| JP | S60-115306 | | 6/1985 |
| JP | S64-87014 | A | 3/1989 |
| JP | 4-371524 | A | 12/1992 |
| JP | H08-300040 | A | 11/1996 |
| JP | 10-202331 | A | 8/1998 |
| JP | H11-290946 | A | 10/1999 |
| JP | 2004-27266 | A | 1/2004 |
| JP | 2004-292936 | A | 10/2004 |
| JP | 2005-219075 | A | 8/2005 |
| JP | 2008-248330 | A | 10/2008 |
| RU | 2307718 | C2 | 10/2007 |
| RU | 2350662 | C1 | 3/2009 |
| WO | WO 2009/018522 | A1 | 2/2009 |

OTHER PUBLICATIONS

ATI Defense, Technical Data Sheet, ATI 500-MIL High Hard Specialty Steel Armor, Sep. 3, 2008.
ATI Defense, Jun. 16, 2008 Press Release, Allegheny Technologies Unveils New Specialty Armor Steel for U.S. and International Defense Markets.
ATI Allegheny Ludlum, Technical Data Sheet, AL 138™ Precipitation Hardening Alloy, 2006.
ATI Allegheny Ludlum, Technical Data Sheet, AL 15-5™ Precipitation Hardening Alloy, 2006.
ATI Allegheny Ludlum, Technical Data Sheet, AL 15-7™ Precipitation Hardening Alloy, 2008.
ATI Allegheny Ludlum, Technical Data Sheet, AL 17-4™ Precipitation Hardening Alloy, 2006.
ATI Allegheny Ludlum, Technical Data Sheet, AL 17-7™ Precipitation Hardening Alloy, 2008.
ATI Allegheny Ludlum, Technical Data Sheet, Stainless Steel Free Machining Grades Types 303 and 416, 1999.
ATI Allegheny Ludlum, Technical Data Sheet, AL 403™ Alloy, Nov. 2000.
ATI Allegheny Ludlum, Technical Data Sheet, Martensitic Stainless Steels Types 410, 420, 425 Mod, and 440A, 2009.
ASTM A6/A6M-08 (2008): Standard Specification for General Requirements for Rolled Structural Steel Bars, Plates, Shapes, and Sheet Piling.

$T_o \geq T_{MS}$ $T_{MF} < T_i < T_{MS}$ $T_f \leq T_{MF}$ $T \geq T_{MS}$ $T \leq T_{MF}$ $T = T_A$

PROCESSES FOR REDUCING FLATNESS DEVIATIONS IN ALLOY ARTICLES

CROSS-REFERENCE TO RELATED APPLICATIONS

This patent application is a continuation application claiming priority under 35 U.S.C. § 120 to co-pending U.S. patent application Ser. No. 12/565,809, filed on Sep. 24, 2009, which patent application is hereby incorporated herein by reference in its entirety.

TECHNICAL FIELD

The present disclosure is directed to processes for reducing flatness deviations in metal and alloy articles, such as, for example, metal and alloy plate and sheet.

BACKGROUND

Iron base alloys (e.g., steels) may be classified, for example, as ferritic, ferritic-austenitic (duplex), austenitic, or martensitic based on the crystal structure of the alloys. Ferritic alloys have a body-centered cubic (BCC) crystal structure. Austenitic alloys have a face-centered cubic (FCC) crystal structure. Ferritic-austenitic (duplex) alloys have a mixed microstructure of austenitic phases and ferritic phases. Ferritic alloys and austenitic alloys have stable phases that are present on an equilibrium phase diagram. Martensitic alloys have non-equilibrium, metastable phases that are not present on an equilibrium phase diagram.

Martensitic alloys may form as a result of diffusionless solid-state phase transformations in the crystal structure of parent alloys (the relative elemental compositions of martensitic alloys and phases and their parent alloys and phases are the same). The change in crystal structure is a result of a homogeneous deformation of a parent phase. For example, martensitic steels form as a result of the diffusionless solid-state phase transformation of austenitic steels from a FCC crystal structure to body-centered tetragonal (BCT) crystal structure. Martensitic phase transformations may occur in various alloys when an alloy comprising a parent phase at an elevated temperature is rapidly cooled (quenched). The cooling (quench) rate from a temperature above a martensitic transformation start temperature of an alloy to a temperature at or less than a martensitic transformation start temperature of the alloy must be sufficiently rapid to prevent solid-state diffusion and the formation of equilibrium phases.

When an alloy is rapidly cooled (quenched) from a temperature above a martensitic transformation start temperature of the alloy, a martensitic phase transformation may begin when the temperature reaches the martensitic transformation start temperature of the alloy. The extent of a martensitic phase transformation increases as the temperature of a cooling alloy decreases below the martensitic transformation start temperature. When the temperature of a cooling alloy reaches a martensitic transformation finish temperature, the crystal structure of the alloy may have entirely transformed from the parent phase to a non-equilibrium, metastable martensitic phase. If a cooling alloy is held at an intermediate temperature between the martensitic transformation start temperature and the martensitic transformation finish temperature, the extent of the martensitic phase transformation does not change with time.

SUMMARY

Embodiments described herein are directed to processes for reducing flatness deviations in an alloy article. The alloy article may comprise alloy sheet, alloy plate, or other planar alloy products. According to a non-limiting embodiment of such a process, an alloy article is heated to a first temperature. The first temperature may be at least as great as a martensitic transformation start temperature of the alloy. A mechanical force is applied to the alloy article at the first temperature. The mechanical force tends to inhibit flatness deviations of a surface of the article. The alloy article is cooled to a second temperature that is no greater than a martensitic transformation finish temperature of the alloy. The mechanical force is maintained on the alloy article during at least a portion of the cooling of the alloy article from the first temperature to the second temperature.

It is understood that the disclosed invention is not limited to the embodiments described in this Summary. The invention is intended to encompass modifications and other subject matter that are within the scope of the invention as defined solely by the claims.

BRIEF DESCRIPTION OF THE DRAWINGS

Various characteristics of the disclosed non-limiting embodiments may be better understood by reference to the accompanying figures, in which.

DETAILED DESCRIPTION OF NON-LIMITING EMBODIMENTS

Figure 1A:
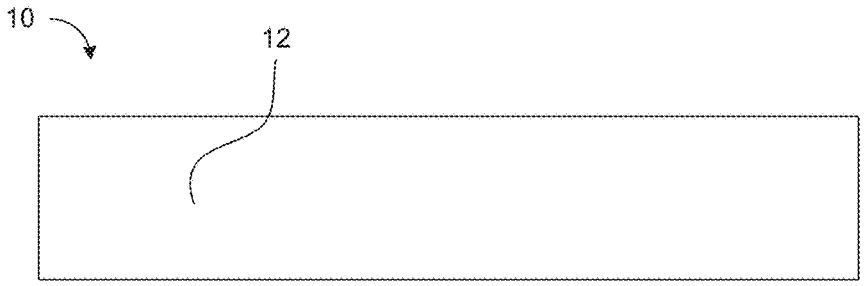
FIG. 1A is a schematic side cross-sectional view of an alloy article at a temperature at least as great as a martensitic transformation start temperature.

It is to be understood that certain descriptions of the embodiments disclosed herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

In the present disclosure, other than where otherwise indicated, all numbers expressing quantities or characteristics are to be understood as being prefaced and modified in all instances by the term "about." Accordingly, unless indicated to the contrary, any numerical parameters set forth in the following description may vary depending on the desired properties one seeks to obtain in the compositions and methods according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. § 112, first paragraph, and 35 U.S.C. § 132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material, in whole or in part, that is said to be incorporated by reference herein, is incorporated herein in its entirety, but only to the extent that the incorporated material does not conflict with existing definitions, statements, or other disclosure material expressly set forth in this disclosure. As such, and to the extent necessary, the express disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

In various alloys, when a parent phase undergoes a martensitic phase transformation, there may be an increase in the specific volume of the alloy material. For example, BCT martensitic steels exhibit a lower density and a greater specific volume than compositionally-identical parent FCC austenitic steels. As a result, when a parent phase alloy is quenched from an elevated temperature to form a martensitic phase alloy, the specific volume of the alloy material may increase.

When a parent phase alloy article is quenched from an elevated temperature to form a martensitic alloy article, the surface and near-surface regions of the article may cool more rapidly than the internal bulk regions of the article. As a result, the parent phase material forming the surface and the near-surface regions of an alloy article may undergo a martensitic phase transformation before the parent phase material forming the internal bulk regions of the article. This may result in an intermediate mixed-phase article comprising an internal bulk region comprising parent phase surrounded by a surface and near-surface region comprising martensitic phase. When the internal bulk region comprising parent phase later transforms to a martensitic phase, it expands, thereby placing the earlier transformed martensitic phase surrounding the later transformed martensitic phase in tension. This may result, for example, in cracking, warping, distortion, or other deformation of the alloy article during and/or after a martensitic phase transformation.

Figure 1B:
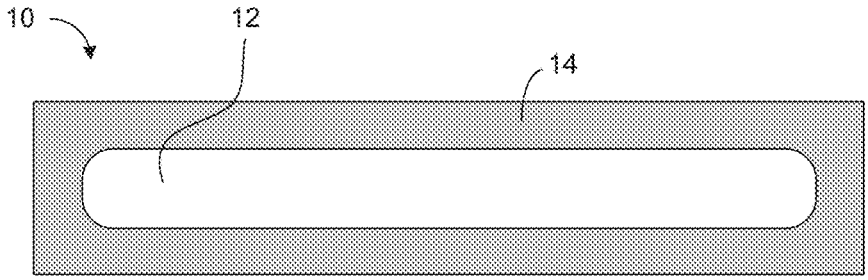
FIG. 1B is a schematic side cross-sectional view of an alloy article, a region of which is at a temperature intermediate a martensitic transformation start temperature and a martensitic transformation finish temperature.
Figure 1C:
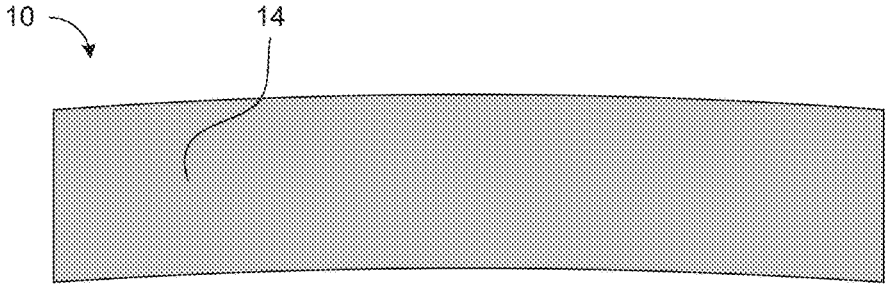
FIG. 1C is a schematic side cross-sectional view of an alloy article at a temperature no greater than a martensitic transformation finish temperature.

FIGS. 1A-1C illustrate an alloy article 10. FIG. 1A shows the alloy article 10 at an initial temperature ($T_o$) at or above a martensitic transformation start temperature ($T_{MS}$) of the alloy. The alloy article 10 comprises all parent phase 12.

FIG. 1B shows the alloy article 10, wherein a surface and near-surface region of the alloy article 10 is at an intermediate temperature ($T_i$) between a martensitic transformation start temperature ($T_{MS}$) of the alloy and a martensitic transformation finish temperature ($T_{MF}$) of the alloy. The alloy article 10 comprises parent phase 12 forming an internal bulk region of the alloy article 10. The internal bulk region remains at a temperature at or above a martensitic transformation start temperature because the internal bulk region has yet to lose sufficient heat energy to decrease the temperature in the region below a martensitic transformation start temperature of the alloy.

The parent phase 12 forming the internal bulk region is surrounded by a martensitic phase 14 forming the surface and near-surface region of the alloy article 10. The surface and near-surface region of the alloy article 10 has lost sufficient heat energy to decrease the temperature below a martensitic transformation start temperature of the alloy. The temperature differential between the regions of the alloy article 10, which results in the different crystal structures in the regions, is due to the fact that surface and near-surface regions lose sufficient heat energy before internal regions of an article.

FIG. 1C shows the alloy article 10 at a final temperature ($T_f$) at or below a martensitic transformation finish temperature ($T_{MF}$) of the alloy. The alloy article 10 comprises all martensitic phase 14. The specific volume of the material forming the alloy article 10 increases during the martensitic phase transformation, which results in a distortion of the alloy article 10, as illustrated in FIG. 1C.

Control of flatness deviations, for example, in alloy sheet, alloy plate, and other planar alloy articles, may be important to users of high-strength and/or high-hardness alloy products. As used herein, a "planar alloy article" refers to an article formed from an alloy material and comprising at least one surface intended to be substantially flat. Planar alloy articles include alloy sheets, alloy plates, and other product forms having planar geometric configurations. Flatness deviations in planar alloy articles intended for application in various assemblies, engineered structures, formed or fabricated components, and the like, may cause difficulties in attaining uniform alignment of mated surfaces, edges, and/or ends of components formed from the planar alloy articles. This may result in a need for costly re-working and/or other corrective measures to meet acceptable shape, size, and/or flatness tolerances (e.g., form and fit characteristics).

Thermal hardening operations in which alloy articles undergo a martensitic phase transformation may induce flatness deviations in the heat treated alloy articles. As a result, hardening heat treatments using air or liquid quenching operations, for example, may produce alloy articles exhibiting flatness deviations. The various embodiments described herein relate to processes that may reduce flatness deviations in hardened alloy articles (e.g., quenched to induce a martensitic phase transformation), which may provide advantages in maintaining dimensional tolerances and shape characteristics of individual and/or assembled alloy articles.

Embodiments described herein are directed to processes for reducing flatness deviations in an alloy article. For example, a process may comprise heating an alloy article to a first temperature that is at least as great as a martensitic transformation start temperature of the alloy. A mechanical force may be applied to the alloy article at the first temperature. The mechanical force may tend to inhibit flatness deviations of a surface of the article. The alloy article may be cooled to a second temperature that is no greater than a martensitic transformation finish temperature of the alloy. The mechanical force may be maintained on the alloy article during at least a portion of the cooling of the alloy article from the first temperature to the second temperature.

In various embodiments, the mechanical force may be maintained on the alloy article continuously as the alloy article cools from the first temperature to the second temperature. In various other embodiments, the mechanical force may be maintained on the alloy article discontinuously as the alloy article cools from the first temperature to the second temperature. The mechanical force may be maintained on the alloy article sequentially as the alloy article cools from the first temperature to the second temperature. For example, the force application may be cyclical or periodic over the period of time during which the alloy article cools from the first temperature to the second temperature. In various embodiments, the mechanical force may be maintained on the alloy article semi-continuously and sequentially as the alloy article cools from the first temperature to the second temperature.

In various embodiments, the mechanical force may be a constant mechanical force. For example, the force may be applied to an alloy article with a constant magnitude and/or in a constant direction. A constant mechanical force may be applied continuously, semi-continuously, or discontinuously throughout the period of time during which an alloy article cools from the first temperature to the second temperature. A constant mechanical force may also be applied sequentially over the period of time during which an alloy article cools from the first temperature to the second temperature. For example, a constant mechanical force may be applied to a surface of an alloy article, removed from the surface of the alloy article, re-applied to the surface of the alloy article, removed from the surface of the alloy article, and so on over the period of time during which the alloy article cools from the first temperature to the second temperature. A constant mechanical force may also be applied uniformly over at least one surface of an alloy article. A constant mechanical force may be applied non-uniformly over at least one surface of an alloy article. For example, a constant mechanical force may be applied to various regions of a surface of an alloy article while no mechanical force is applied to other regions of the surface.

In various embodiments, the mechanical force may be a varying mechanical force. For example, the force may be applied to an alloy article with varying magnitude and/or in varying directions. A varying mechanical force may be applied continuously, semi-continuously, or discontinuously throughout the period of time during which an alloy article cools from the first temperature to the second temperature. A varying mechanical force may also be applied sequentially over the period of time during which an alloy article cools from the first temperature to the second temperature. For example, a mechanical force may be applied to a surface of an alloy article so that the magnitude of the applied force varies according to a predetermined cyclical waveform over the period of time during which the alloy article cools from the first temperature to the second temperature. A varying mechanical force may be applied uniformly over at least one surface of an alloy article. A varying mechanical force may also be applied non-uniformly over a surface of an alloy article. For example, a varying mechanical force may be applied to various regions of a surface of an alloy article while no mechanical force is applied to other regions of the surface.

Figure 2A:
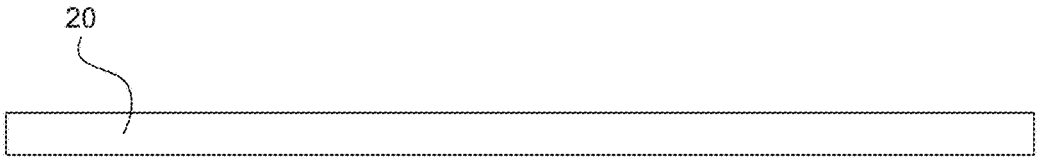
FIGS. 2A-2C are schematic side views of an alloy article illustrating the development of a flatness deviation as the alloy article is cooled from a temperature at least as great as a martensitic transformation start temperature (FIG. 2A) to a temperature no greater than a martensitic transformation finish temperature (FIG. 2B), and ultimately to an ambient temperature (FIG. 2C)
Figure 2B:
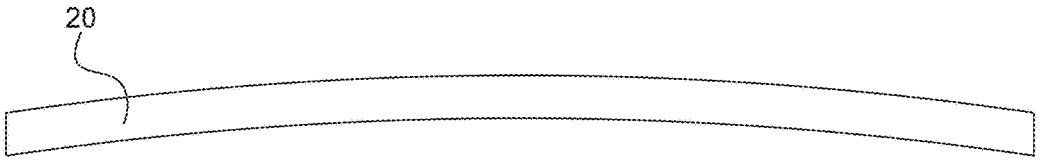
Figure 2C:
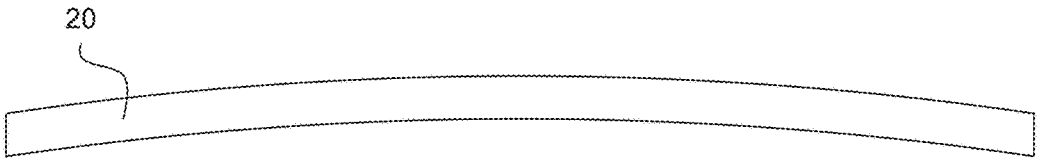

FIGS. 2A-2C illustrate an alloy article 20, in which FIG. 2A shows the alloy article 20 at a temperature (T) at least as great as a martensitic transformation start temperature ($T_{MS}$) of the alloy. FIG. 2B shows the alloy article 20 at a temperature (T) no greater than a martensitic transformation finish temperature ($T_{MF}$) of the alloy, and FIG. 2C shows the alloy article 20 at a temperature (T) equal to an ambient temperature ($T_A$). An external force is not applied to the alloy article 20 as it is cooled from a temperature at least as great as a martensitic transformation start temperature of the alloy (FIG. 2A) to a temperature no greater than a martensitic transformation finish temperature of the alloy (FIGS. 2B and 2C). As shown in FIGS. 2B and 2C, the alloy article 20 exhibits a flatness deviation in a longitudinal direction after a martensitic phase transformation. Geometric distortions and flatness deviations of the alloy article 20 may occur in a longitudinal direction (as shown in FIGS. 2B and 2C) and/or a transverse direction (not shown in FIGS. 2B and 2C).

Generally, planar alloy articles are more susceptible to distortion and flatness deviations as the gauge (i.e., thickness) of the article decreases and as the length and/or width (i.e., the physical dimensions of the at least one surface intended to be substantially flat) of the article increases.

Figure 3A:
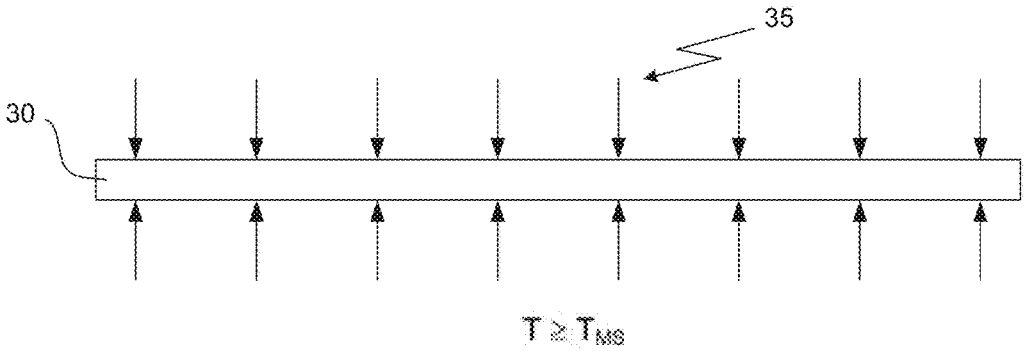
FIGS. 3A-3C are schematic side views of an alloy article illustrating an embodiment of a process for reducing flatness deviations in the alloy article, in which compressive force is applied to the alloy article as the alloy article is cooled from a temperature at least as great as a martensitic transformation start temperature (FIG. 3A) to a temperature no greater than a martensitic transformation finish temperature (FIG. 3B), and ultimately to an ambient temperature condition where no compressive force is applied to the alloy article (FIG. 3C)
Figure 3B:
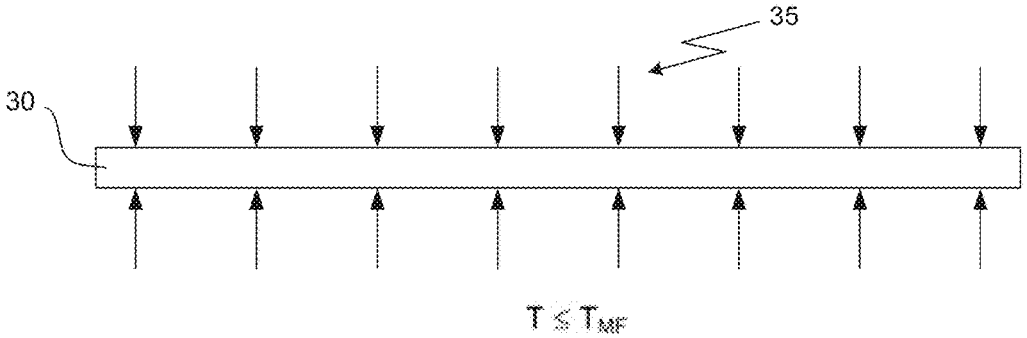
Figure 3C:
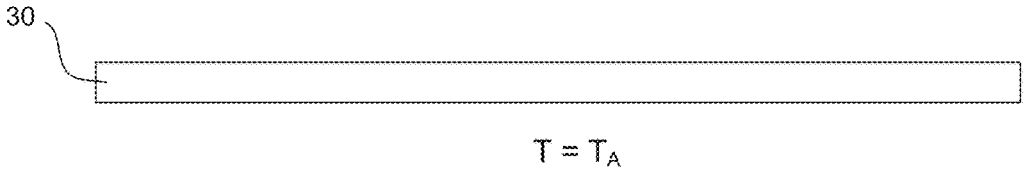

In various embodiments, a mechanical force applied to an alloy article may comprise a force compressing the alloy article. FIGS. 3A-3C illustrate an alloy article 30, in which FIG. 3A shows the alloy article 30 at a temperature (T) at least as great as a martensitic transformation start temperature ($T_{MS}$) of the alloy. FIG. 3B shows the alloy article 30 at a temperature (T) no greater than a martensitic transformation finish temperature ($T_{MF}$) of the alloy, and FIG. 3C shows the alloy article 30 at a temperature (T) equal to an ambient temperature ($T_A$). A compressive force, indicated by arrows 35, is applied to alloy article 30 as it is cooled from a temperature at least as great as a martensitic transformation start temperature of the alloy (FIG. 3A) to a temperature no greater than a martensitic transformation finish temperature of the alloy (FIG. 3B). As shown in FIG. 3C, the alloy article 30 exhibits substantially reduced flatness deviations after a martensitic phase transformation. The substantial reduction in flatness deviations remains after the compressive force is removed and the alloy article 30 reaches an ambient temperature.

In various embodiments, a compressive mechanical force may be applied using a roller leveling operation. Roller leveling may begin when an alloy article is at temperature at least as great as a martensitic transformation start temperature of the alloy and end when the alloy article has cooled to a temperature no greater than a martensitic transformation finish temperature of the alloy. During a roller leveling operation, the rollers may apply a semi-continuous and sequential force to an alloy article as the location of contact between the rollers and the surface of the alloy article changes over time.

In various embodiments, during a roller leveling operation, the alloy article may be in contact with leveling rollers during cooling throughout a temperature range beginning at or above a martensitic transformation start temperature and ending at or below a martensitic transformation finish temperature. A roller leveling operation may comprise roller leveling an alloy article with a single pass. The single pass may begin when an alloy article is at a temperature at least as great as a martensitic transformation start temperature and may end when the alloy article has cooled to a temperature no greater than a martensitic transformation finish temperature. A roller leveling operation may comprise roller leveling an alloy article with multiple passes. A first pass may begin when an alloy article is at a temperature at least as great as a martensitic transformation start temperature and a final pass may end when the alloy article has cooled to a temperature no greater than a martensitic transformation finish temperature.

In various embodiments, a compressive mechanical force may be applied using a platen press leveling operation. For example, an alloy article may be placed between two parallel faces of a platen press. A compressive force may be applied to the article through a mechanical pressing action of the platen press. The platen pressing may begin when an alloy article is at a temperature at least as great as a martensitic transformation start temperature of the alloy and may end when the alloy article has cooled to a temperature no greater than a martensitic transformation finish temperature of the alloy.

In various embodiments, during a platen press leveling operation, a compressive mechanical force may be maintained on an alloy article during at least a portion of the cooling of the alloy article from a temperature at least as great as a martensitic transformation start temperature of the alloy to a temperature no greater than a martensitic transformation finish temperature of the alloy. The alloy article may be in continuous or discontinuous contact with the face of at least one platen during cooling throughout a temperature range beginning at or above a martensitic transformation start temperature and ending at or below a martensitic transformation finish temperature. A constant or varying compressive force may be maintained on an alloy article continuously or discontinuously by the platens of a platen press as the alloy article cools from a temperature at least as great as a martensitic transformation start temperature of the alloy to a temperature no greater than a martensitic transformation finish temperature of the alloy.

Figure 4A:
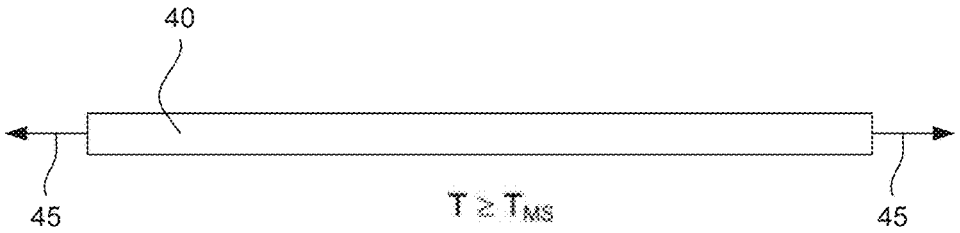
FIGS. 4A-4C are schematic side views of an alloy article illustrating another embodiment of a process for reducing flatness deviations in the alloy article, in which tensile force is applied to the alloy article as the alloy article is cooled from a temperature at least as great as a martensitic transformation start temperature (FIG. 4A) to a temperature no greater than a martensitic transformation finish temperature (FIG. 4B), and ultimately to an ambient temperature condition where no tensile force is applied to the alloy article (FIG. 4C)
Figure 4B:
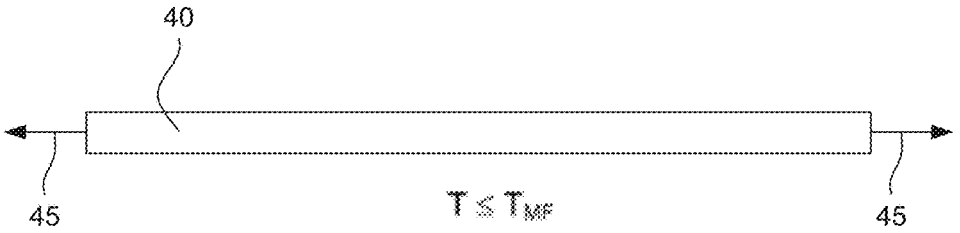
Figure 4C:
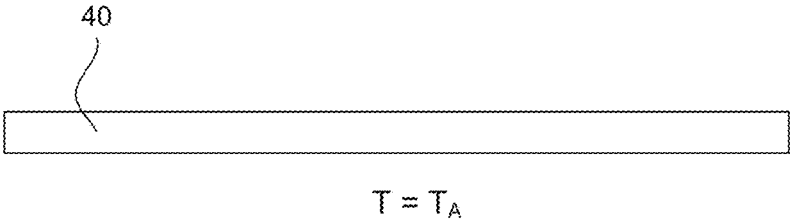

In various embodiments, a mechanical force applied to an alloy article may comprise a force placing the alloy article in tension. FIGS. 4A-4C illustrate an alloy article 40, in which FIG. 4A shows the alloy article 40 at a temperature (T) at least as great as a martensitic transformation start temperature ($T_{MS}$) of the alloy. FIG. 4B shows the alloy article 40 at a temperature (T) no greater than a martensitic transformation finish temperature ($T_{MF}$) of the alloy, and FIG. 4C shows the alloy article 30 at a temperature (T) equal to an ambient temperature ($T_A$). A tensile force, indicated by arrows 45, is applied to alloy article 40 as it is cooled from a temperature at least as great as a martensitic transformation start temperature of the alloy (FIG. 4A) to a temperature no greater than a martensitic transformation finish temperature of the alloy (FIG. 4B). As shown in FIG. 4C, the alloy article 40 exhibits substantially reduced flatness deviations after a martensitic phase transformation. The substantial reduction of flatness deviations remains after the tensile force is removed and the alloy article 40 reaches an ambient temperature.

In various embodiments, a tensile force may be applied using a stretching operation. The application of a tensile force using a stretching operation may begin when an alloy article is at a temperature at least as great as a martensitic transformation start temperature of the alloy and end when the alloy article has cooled to a temperature no greater than a martensitic transformation finish temperature of the alloy.

In various embodiments, during a stretching operation, a tensile stretching force may be maintained on an alloy article by pulling the alloy article simultaneously in opposite directions during at least a portion of the cooling of the alloy article from a temperature at least as great as a martensitic transformation start temperature of the alloy to a temperature no greater than a martensitic transformation finish temperature of the alloy. A constant or varying tensile stretching force may be maintained on an alloy article continuously or discontinuously as the alloy article cools from a temperature at least as great as a martensitic transformation start temperature of the alloy to a temperature no greater than a martensitic transformation finish temperature of the alloy.

In various embodiments, an alloy article may comprise an alloy sheet, an alloy plate, or other planar alloy article. In various embodiments, an alloy article may comprise a ferrous martensitic alloy or a non-ferrous martensitic alloy. For example, alloy articles processed according to the processes disclosed herein may include, but are not limited to, titanium-base martensitic alloy articles, cobalt-base martensitic alloy articles, and other non-ferrous martensitic alloy articles.

In various embodiments, an alloy article may comprise a martensitic steel article or a martensitic stainless steel article. In various embodiments, an alloy article may comprise a precipitation-hardening steel article or a precipitation-hardening stainless steel article. Alloy articles processed according to the processes disclosed herein may include, but are not limited to, 400 series stainless steel articles, 500 series low alloy steel articles, and 600 series stainless steel articles. For example, an alloy may comprise a Type 403 stainless steel, Type 410 stainless steel, Type 416 stainless steel, Type 419 stainless steel, Type 420 stainless steel, Type 440 stainless steel, Type 522 low alloy steel, Type 529 low alloy steel, 13-8 stainless steel, 15-5 stainless steel, 15-7 stainless steel, 17-4 stainless steel, or 17-7 stainless steel. In various embodiments, an alloy article may comprise a stainless steel comprising a nominal chemical composition as specified in Table 1 or Table 2.

TABLE 1

| Element | Composition (weight percent) | | | | |
|---|---|---|---|---|---|
| | Steel-1 | Steel-2 | Steel-3 | Steel-4 | Steel-5 |
| C | 0.15 (max) | 0.15 (max) | 0.15 (max) | 0.15-0.40 | 0.60-0.75 |
| Ni | 0.60 (max) | 0.75 (max) | — | 0.50 (max) | 0.50 (max) |
| Cr | 11.50-13.00 | 11.50-13.50 | 12.00-14.00 | 12.00-14.00 | 16.00-18.00 |
| Mo | — | — | 0.60 (max) | — | 0.75 (max) |
| Mn | 1.00 (max) | 1.00 (max) | 1.25 (max) | 1.00 (max) | 1.00 (max) |
| Si | 0.50 (max) | 1.00 (max) | 1.00 (max) | 1.00 (max) | 1.00 (max) |
| P | 0.04 (max) | 0.04 (max) | 0.06 (max) | 0.04 (max) | 0.04 (max) |
| S | 0.03 (max) | 0.03 (max) | 0.15 (max) | 0.03 (max) | 0.03 (max) |
| Fe | balance plus incidental or residual elements | | | | |

TABLE 2

| Element | Composition (weight percent) | | | | |
|---|---|---|---|---|---|
| | Steel-6 | Steel-7 | Steel-8 | Steel-9 | Steel-10 |
| C | 0.05 (max) | 0.04 (max) | 0.07 (max) | 0.04 (max) | 0.07 (max) |
| Ni | 7.50-8.50 | 4.80-5.20 | 6.50-7.50 | 4.00-4.50 | 6.50-7.50 |
| Cr | 12.25-13.25 | 14.50-15.50 | 14.50-15.50 | 15.5-16.00 | 16.50-17.50 |
| Mo | 2.00-2.50 | — | 2.00-2.50 | — | — |
| Mn | 0.20 (max) | 0.75 (max) | 0.50 (max) | 0.40 (max) | 0.50 (max) |
| Si | 0.10 (max) | 0.50 (max) | 0.30 (max) | 0.50 (max) | 0.25 (max) |
| Al | 0.90-1.35 | — | 0.90-1.35 | — | 0.90-1.35 |
| Cu | — | 3.40-3.60 | — | 3.40-3.60 | — |
| Nb + Ta | — | 0.30 (max) | — | 0.30 (max) | — |
| P | 0.010 (max) | 0.020 (max) | 0.015 (max) | 0.020 (max) | 0.020 (max) |
| S | 0.008 (max) | 0.005 (max) | 0.010 (max) | 0.005 (max) | 0.002 (max) |
| Fe | balance plus incidental or residual elements | | | | |

In various embodiments, an alloy article may comprise an alloy sheet, an alloy plate, or other planar alloy article comprising an air-hardenable high-strength and/or high-hardness steel alloy. For example, in various embodiments, an alloy article may comprise a steel comprising a nominal chemical composition as specified in Table 3 or Table 4.

TABLE 3

| Element | Composition (weight percent) |
|---|---|
| C | 0.22-0.32 |
| Ni | 3.50-4.00 |
| Cr | 1.60-2.00 |
| Mo | 0.22-0.37 |
| Mn | 0.80-1.20 |
| Si | 0.25-0.45 |
| P | 0.020 (max) |
| S | 0.005 (max) |
| Fe | balance plus incidental or residual elements |

TABLE 4

| Element | Composition (weight percent) |
|---|---|
| C | 0.42-0.52 |
| Ni | 3.75-4.25 |
| Cr | 1.00-1.50 |
| Mo | 0.22-0.37 |
| Mn | 0.20-1.00 |
| Si | 0.20-0.50 |
| P | 0.020 (max) |
| S | 0.005 (max) |
| Fe | balance plus incidental or residual elements |

In various embodiments, an alloy article processed according to a process as described herein may comprise an alloy comprising, in weight percent, 0.22-0.32 carbon, 3.50-4.00 nickel, 1.60-2.00 chromium, 0.22-0.37 molybdenum, 0.80-1.20 manganese, and 0.25-0.45 silicon. In various embodiments, an alloy article processed according to a process as described herein may comprise an alloy comprising, in weight percent, 0.42-0.52 carbon, 3.75-4.25 nickel, 1.00-1.50 chromium, 0.22-0.37 molybdenum, 0.20-1.00 manganese, and 0.20-0.50 silicon.

An alloy article processed according to various embodiments of the processes described herein may comprise a planar alloy article having a thickness in the range of 0.030 inches to 5.000 inches. In various embodiments, a planar alloy article processed according the processes described herein may have a thickness in the range of 0.030 inches to 2.000 inches.

In various embodiments, cooling from a temperature at or above a martensitic transformation start temperature of an alloy to a temperature at or below a martensitic transformation finish temperature of an alloy may be conducted at an estimated temperature reduction rate of 0.0001° F./sec. to 1000° F./sec. The actual temperature reduction rate utilized will depend on the martensitic transformation start temperature of an alloy, the martensitic transformation finish temperature of an alloy, the temperature at which a force is initially applied to an alloy article, the temperature of any processing equipment in contact with an alloy article, the environmental temperature surrounding the alloy article, the geometric dimensions and shape of the alloy article, and the chemical composition of the particular alloy forming the article.

In various embodiments, the cooling from a temperature at or above a martensitic transformation start temperature of an alloy to a temperature at or below a martensitic transformation finish temperature of an alloy may be conducted using air cooling. An article processed according to the processes described herein may be convectively air cooled by forced air currents flowing over the article, or an article may be convectively air cooled within an ambient air environment without forced air flow. An article processed according to the processes described herein may be conductively cooled by the transfer of heat energy from the article through any processing equipment surfaces in contact with an alloy article. In various embodiments, an article processed according to the processes described herein may be convectively air cooled and conductively cooled by heat transfer through processing equipment surfaces in contact with the alloy article.

Figure 5:
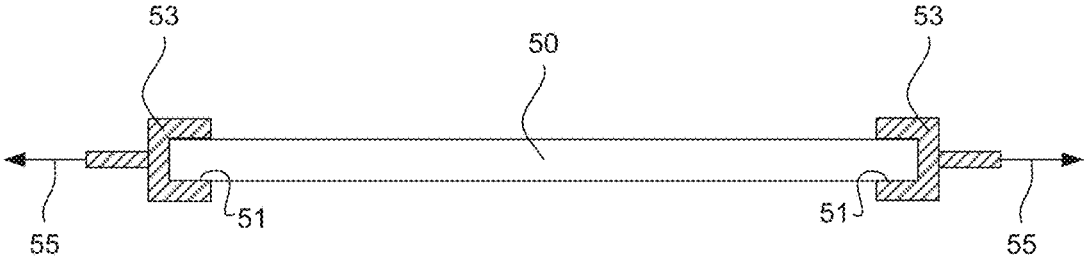
FIG. 5 is a schematic cross-sectional side view of an alloy article undergoing a stretching operation.

In a stretching operation, for example, regions at and/or near opposed ends of an alloy article may be in contact with processing equipment, and most of the major planar surfaces of the alloy article may be in contact with forced or ambient air. FIG. 5 illustrates an alloy article 50 undergoing a stretching operation in which a tensile force, indicated by arrows 55, is applied to the alloy article 50 through processing equipment 53. The processing equipment 53 is in contact with the alloy article 50 in regions 51 at and near opposed ends of the alloy article 50. The majority of the major planar surfaces of alloy article 50 are in contact with forced or ambient air. In this manner, heat may convectively transfer from the major planar surfaces in contact with air and heat may conductively transfer through processing equipment 53.

Figure 6:
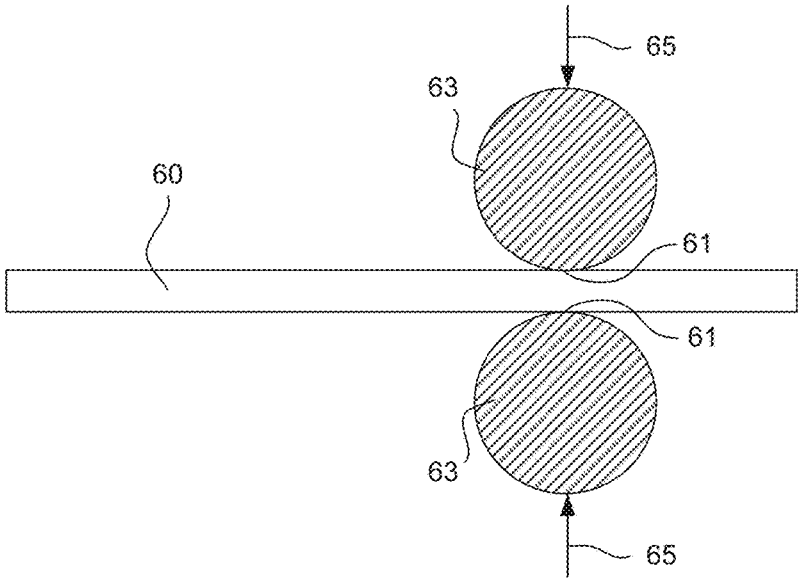
FIG. 6 is a schematic cross-sectional side view of an alloy article undergoing a roller leveling operation.

In a roller leveling operation, for example, regions of major planar surfaces of an alloy article may be in contact with the roller surfaces, and other regions of the major planar surfaces may be in contact with forced or ambient air. FIG. 6 illustrates an alloy article 60 undergoing a roller leveling operation in which a compressive force, indicated by arrows 65, is applied to the alloy article 60 through rollers 63. The rollers 63 are in contact with the alloy article 60 in regions 61 on the major planar surfaces of the alloy article 60. The majority of the major planar surfaces of alloy article 60 are in contact with forced or ambient air. In this manner, heat may convectively transfer from the planar surfaces in contact with air and heat may conductively transfer through the rollers 63. As the rollers proceed over the major planar surfaces of the alloy article 60, additional heat may conductively transfer from the alloy article 60 through the rollers 63.

Figure 7:
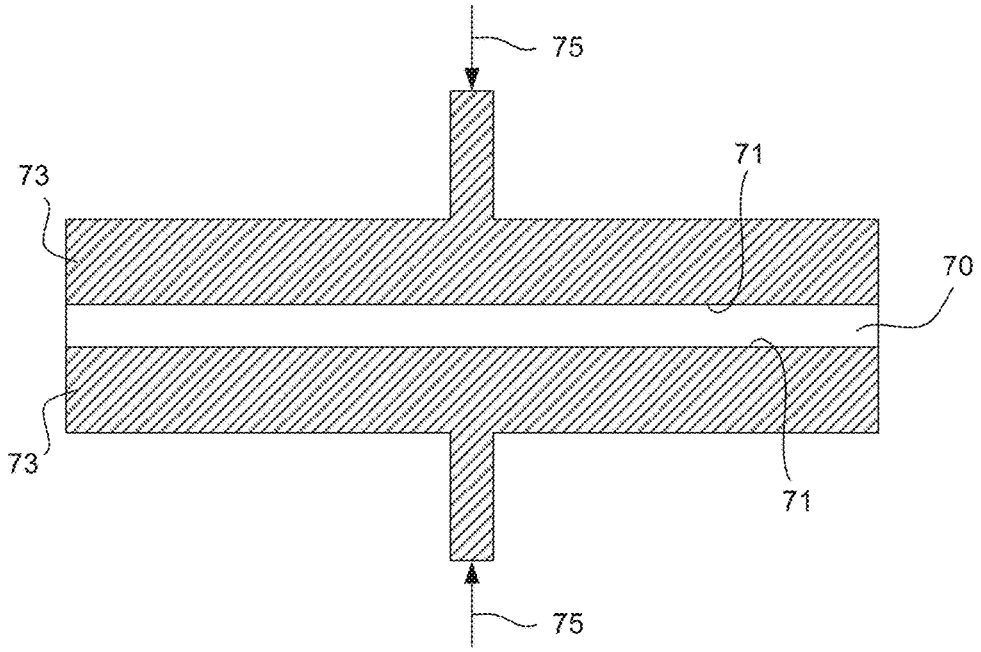
FIG. 7 is a schematic cross-sectional side view of an alloy article undergoing a platen press leveling operation.

In a platen press leveling operation, for example, regions of major planar surfaces of an alloy article may be in contact with one or more platens, and other regions of the major planar surface may be in contact with forced or ambient air. Alternatively, in a platen press leveling operation, the entire major planar surfaces of an alloy article may be in contact with one or more platens, and no region of the major planar surface may be in contact with forced or ambient air. FIG. 7 illustrates an alloy article 70 undergoing a platen press leveling operation in which a compressive force, indicated by arrows 75, is applied to the alloy article 70 through platens 73. The platens 73 are in contact with the alloy article 70 in regions 71, which form the entire major planar surfaces of the alloy article 70. The major planar surfaces 71 of alloy article 70 are not in contact with forced or ambient air. In this manner, heat may conductively transfer from the major planar surfaces 71, which are in contact with the platens 73. Heat may also convectively transfer from side and end surfaces of the alloy article 70 that are in contact with air.

According to various embodiments, for three identical alloy articles respectively undergoing a stretching operation, a roller leveling operation, and a platen press leveling operation, it would be expected that the cooling rate observed in a platen press leveling operation is greater than the cooling rate observed in a roller leveling operation, which would be greater than the cooling rate observed in a stretching operation, provided that all other temperature variables are equal (i.e., ambient air temperature, temperature of the processing equipment contacting surfaces, and the like).

In various embodiments, an applied mechanical force may have a magnitude equal to, or greater than, the yield strength (in compression or in tension, respectively) of the alloy article at the temperature points within the processing temperature range (i.e., from a starting temperature at least as great as a martensitic transformation start temperature of the alloy to an ending temperature no greater than a martensitic transformation finish temperature of the alloy). In this manner, the magnitude and/or direction of the applied force may be dependent upon the processing temperature range of the alloy article, the particular chemical composition of the alloy, and/or the geometric shape and dimensions of the alloy article.

The magnitude and/or direction of the applied force may also vary depending upon the particular operation used to apply the force (e.g., stretching, roller leveling, and platen press leveling). In various embodiments, the applied force may have a magnitude approaching the ultimate tensile strength at the temperature at which the force is applied. In various embodiments, the applied force may have a magnitude approximately equal to the yield strength (compression or tension, respectively) of the alloy article. In various embodiments, the applied force may have a magnitude that does not reduce the thickness of the alloy article during the force application operation. In various embodiments, the applied force may have a magnitude less than the yield strength (compression or tension, respectively) of the alloy article.

In various embodiments, a roller leveling operation applies force to major planar surfaces of a planar alloy article within the contact areas of the rollers. In order to apply a relatively uniform compressive force, the alloy article is introduced to the contact area of the rollers in a continuous and sequential manner, wherein the rollers apply a relatively constant force to the major planar surfaces of the alloy article. In this manner, adjacent areas of the major planar surfaces sequentially experience the same forces under the same conditions.

Figure 8:
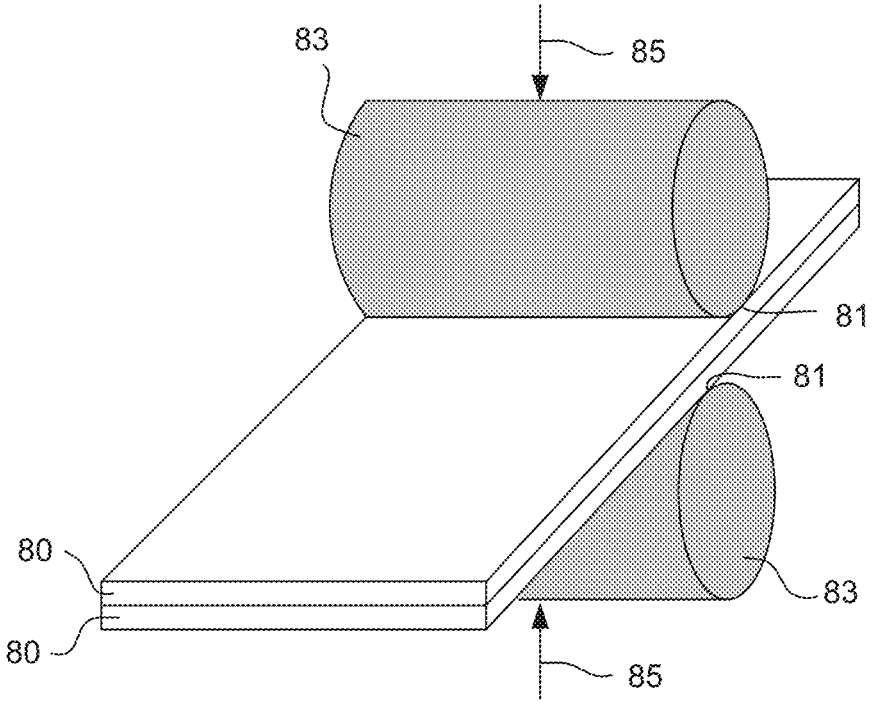
FIG. 8 is a schematic perspective view of a stack of two alloy articles undergoing a roller leveling operation.

In various embodiments, two or more planar alloy articles may be stacked so that major planar surfaces of the alloy articles are in contact, and a force is applied to the stack. For example, FIG. 8 illustrates a stack of two planar alloy articles 80 undergoing a roller leveling operation in which a compressive force, indicated by arrows 85, is applied through rollers 83 to the stack of alloy articles 80. The rollers 83 are in contact with the stack of alloy articles 80 in regions 81 on the top major planar surface of the top alloy article 80 and the bottom major planar surface of the bottom alloy article 80. Although FIG. 8 only shows two alloy articles undergoing a roller leveling operation, it is understood that more than two alloy articles may be stacked in like manner, and that two or more stacked alloy articles may undergo a platen press leveling operation or a stretching operation according to various embodiments described herein.

In various embodiments, the processes described herein are integrated with a hardening heat treatment and subsequent cooling of a martensitic and/or precipitation hardening alloy to form a martensitic phase and/or precipitation hardened alloy from a parent phase alloy. In various embodiments, the processes described herein may be applied to previously processed alloy articles to remedy flatness deviations developed during and/or after the previous processing. For example, a martensitic alloy article exhibiting flatness deviations may be re-heated to a temperature at least as great as a martensitic transformation start temperature, or a temperature below the martensitic transformation start temperature, or a temperature below the martensitic transformation finish temperature, and processed according to the various embodiments described herein. However, care must be taken because remedial processing according to various embodiments described herein may have various effects on the alloy article, including, but not necessarily limited to, causing metallurgical differences in the grain size, toughness, strength, hardness, corrosion resistance, ballistic resistance, and the like, when comparing an alloy article before remedial processing and after remedial processing.

The illustrative and non-limiting examples that follow are intended to further describe the embodiments presented herein without restricting their scope. Persons having ordinary skill in the art will appreciate that variations of the Examples are possible within the scope of the invention as defined solely by the claims. All parts and percents are by weight unless otherwise indicated.

EXAMPLES

Example 1

A 0.250×101×252 inch alloy plate was prepared from a high strength steel alloy having a nominal composition as specified in Table 5.

TABLE 5

| Element | Composition (weight percent) |
|---|---|
| C | 0.22-0.32 |
| Ni | 3.50-4.00 |
| Cr | 1.60-2.00 |
| Mo | 0.22-0.37 |
| Mn | 0.80-1.20 |
| Si | 0.25-0.45 |
| P | 0.020 (max) |
| S | 0.005 (max) |
| Fe | balance plus incidental or residual elements |

The steel alloy plate was placed into a furnace and heated to a temperature greater than the martensitic transformation start temperature of the steel alloy. A mechanical force was applied to the plate using a roller flattening operation comprising seven (7) passes through the rollers. The mechanical force was initiated (i.e., the first pass) at a temperature of 516° F. The application of mechanical force ended (i.e., the seventh pass) when the plate reached a temperature of 217° F. The plate was cooled in ambient air during the roller leveling operation. The cooling profile for the plate is provided in Table 6.

TABLE 6

| Pass No. | Plate Temperature (° F.) |
|---|---|
| 1 | 516 |
| 2 | 466 |
| 3 | 458 |
| 4 | 390 |
| 5 | 365 |
| 6 | 265 |
| 7 | 217 |

A total of 19 minutes elapsed between the initiation of the first pass and the end of the seventh pass. The plate was rolled continuously from the first pass through the fifth pass. The rolling was interrupted between the fifth and sixth pass to allow the plate to cool without force application. The plate was rolled continuously for the sixth and seventh passes. The plate was allowed to cool to ambient temperature (approximately 70° F.) without force application after the seventh pass.

Figure 9A:
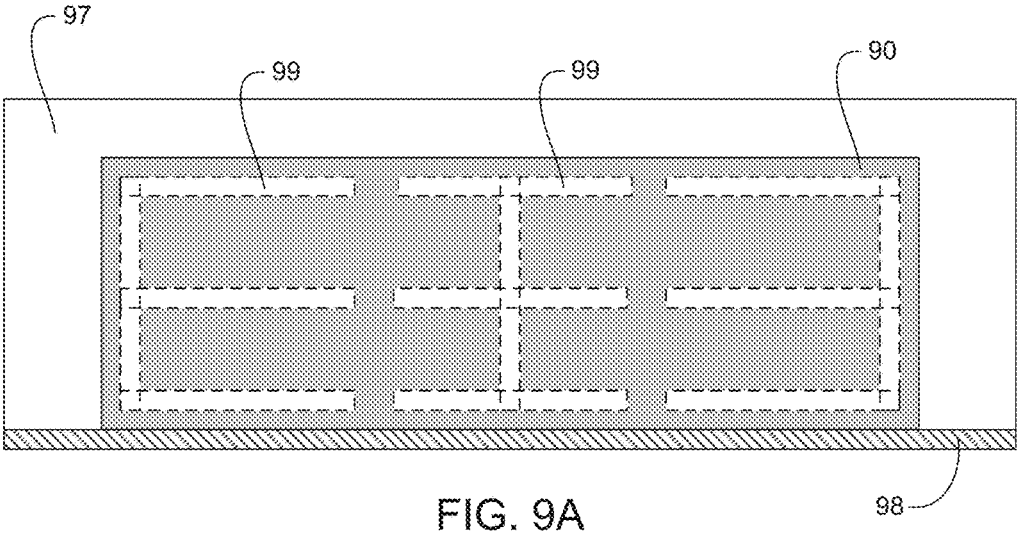
FIG. 9A is a schematic top view of a flatness deviation measurement table showing the positioning of a straight edge bar used to measure flatness deviations in an alloy plate.
Figure 9B:
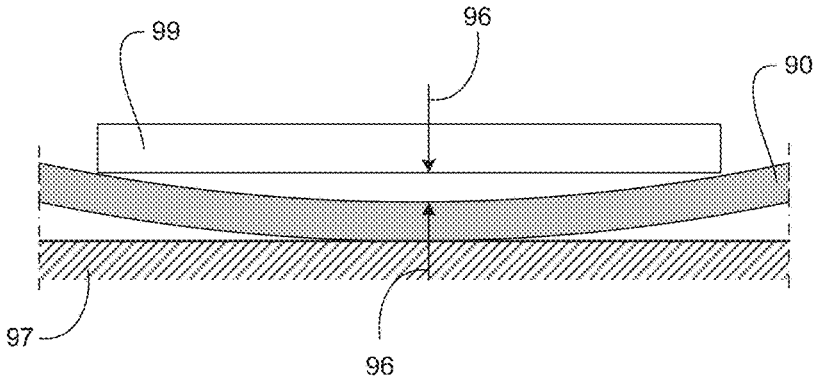
FIG. 9B is a schematic cross-sectional side view of an alloy plate exhibiting a flatness deviation and positioned on a flatness deviation measurement table, wherein a straight edge bar is used to measure the flatness deviation.

The plate at ambient temperature was tested for flatness deviations using a flatness table. FIGS. 9A and 9B illustrate a flatness table 97 having a stop 98. As shown in FIG. 9A, a plate 90 is positioned within the perimeter of the surface of the table 97 and against stop 98. A straight edge bar 99 is positioned on various locations of the surface of the plate 90, as shown in FIG. 9A. At each position, flatness deviations measured as gap values (indicated by arrows 96 in FIG. 9B) are measured as the largest distance between the lower edge of the bar 99 and the plate surfaces.

The flatness table and the plate were clean and free of debris. The 0.250×101×252 inch plate was positioned within the perimeter of the table surface. One plate edge was butted against the stops along one side of the table. A 9 foot aluminum straight edge bar was used for all flatness deviation measurements. The 9 foot straight edge bar was positioned as illustrated in FIG. 9A. At each position, the maximum flatness deviation between the lower edge of the bar and the plate surface was measured at three locations along the 9 foot length of the bar.

The 0.250×101×252 inch steel plate had a maximum longitudinal flatness deviation of 3/32 of an inch (0.09375") (straight edge bar positioned parallel to the 253 inch dimension), and a maximum transverse flatness deviation of ¼ of an inch (0.25") (straight edge bar positioned parallel to the 101 inch dimension). The maximum tolerance for flatness deviations in a 0.250×101×252 inch high strength steel plate is 2 inches per ASTM A6/A6M-08 *Standard Specification for General Requirements for Rolled Structural Steel Bars, Plates, Shapes, and Sheet Piling,* incorporated by reference herein. Although ASTM A6/A6M-08 provides tolerance values measured in 12 foot sections, the flatness deviations measured here using a 9 foot bar are representative and should not materially differ from measurements made using a 12 foot bar given the significantly low magnitude of the measured flatness deviations.

Example 2

A 0.200×102×296 inch alloy plate was prepared from a high strength steel alloy having a nominal composition as specified in Table 5. The steel alloy plate was placed into a furnace and heated to a temperature greater than the martensitic transformation start temperature of the steel alloy. A mechanical force was applied to the plate using a roller flattening operation comprising nine (9) passes through the rollers. The plate was rolled continuously from the first pass through the ninth pass. The mechanical force was initiated (i.e., the first pass) at a temperature of 585° F. The application of mechanical force ended (i.e., the ninth pass) when the plate reached a temperature of 233° F. The plate was cooled in ambient air during the roller leveling operation. The cooling profile for the plate is provided in Table 7.

TABLE 7

| Pass No. | Plate Temperature (° F.) |
|---|---|
| 1 | 585 |
| 2 | — |
| 3 | 470 |
| 4 | 450 |
| 5 | 400 |
| 6 | — |
| 7 | 320 |
| 8 | 275 |
| 9 | 233 |

The plate was allowed to cool to ambient temperature (approximately 70° F.) without force application after the ninth pass. The plate at ambient temperature was tested for flatness deviations using a flatness table as described in connection with Example 1.

The 0.200×102×296 inch steel plate had a maximum longitudinal flatness deviation of 1/16 of an inch (0.0625") (straight edge bar positioned parallel to the 296 inch dimension), and a maximum transverse flatness deviation of 7/32 of an inch (0.21875") (straight edge bar positioned parallel to the 102 inch dimension). The maximum tolerance for flatness deviations in a 0.200×102×296 inch high strength steel plate is 2 and 3/8 inches (2.375") per ASTM A6/A6M-08.

Example 3

A 0.200×103×292 inch alloy plate was prepared from a high strength steel alloy having a nominal composition as specified in Table 5. The steel alloy plate was placed into a furnace and heated to a temperature greater than the martensitic transformation start temperature of the steel alloy. A mechanical force was applied to the plate using a roller flattening operation comprising nine (9) passes through the rollers. The plate was rolled continuously from the first pass through the ninth pass. The mechanical force was initiated (i.e., the first pass) at a temperature of 585° F. The application of mechanical force ended (i.e., the ninth pass) when the plate reached a temperature of 263° F. The plate was cooled in ambient air during the roller leveling operation. The cooling profile for the plate is provided in Table 8.

TABLE 8

| Pass No. | Plate Temperature (° F.) |
|---|---|
| 1 | 585 |
| 2 | — |
| 3 | — |
| 4 | 436 |
| 5 | — |
| 6 | — |
| 7 | — |
| 8 | — |
| 9 | 263 |

The plate was allowed to cool to ambient temperature (approximately 70° F.) without force application after the ninth pass. The plate at ambient temperature was tested for flatness deviations using a flatness table as described in connection with Example 1.

The 0.200×103×292 inch steel plate had a maximum longitudinal flatness deviation of 1/16 of an inch (0.0625") (straight edge bar positioned parallel to the 292 inch dimension), and a maximum transverse flatness deviation of 17/64 of an inch (0.265625") (straight edge bar positioned parallel to the 103 inch dimension). The maximum tolerance for flatness deviations in a 0.200×102×296 inch high strength steel plate is 2 and 3/8 inches (2.375") per ASTM A6/A6M-08.

The present disclosure has been written with reference to various exemplary, illustrative, and non-limiting embodiments. However, it will be recognized by persons having ordinary skill in the art that various substitutions, modifications or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining, modifying, or reorganizing any of the disclosed steps, ingredients, constituents, components, elements, features, aspects, and the like, of the embodiments described herein. Thus, this disclosure is not limited by the description of the various exemplary, illustrative, and non-limiting embodiments, but rather solely by the claims. In this manner, Applicants reserve the right to amend the claims during prosecution to add features as variously described herein.

What is claimed is:

1. A process for the remediation of flatness deviations in an alloy article, the process comprising:

heating the alloy article to an elevated temperature;

applying a mechanical force to the alloy article at the elevated temperature, the mechanical force tending to inhibit flatness deviations of a surface of the article; and air cooling the alloy article from the elevated temperature, wherein the mechanical force is maintained on the alloy article during at least a portion of the air cooling of the alloy article from the elevated temperature, and wherein after the mechanical force is no longer applied to the alloy article, the alloy article has reduced flatness deviations relative to the alloy article just prior to heating the alloy article to the elevated temperature.

2. The process of claim 1, wherein the elevated temperature is at least as great as a martensitic transformation start temperature of the alloy article.

3. The process of claim 1, wherein the air cooling the alloy article from the elevated temperature comprises cooling the alloy article in an ambient air environment without forced air flow over the alloy article.

4. The process of claim 1, wherein the air cooling the alloy article from the elevated temperature comprises cooling the alloy article using forced air flow over the alloy article.

5. The process of claim 1, wherein the alloy article is not liquid quenched.

6. The process of claim 1, wherein the mechanical force is maintained one of continuously and semi-continuously on the alloy article during the air cooing the alloy article from the elevated temperature.

7. The process of claim 6, wherein the mechanical force is a constant mechanical force.

8. The process of claim 1, wherein the mechanical force is applied on the alloy article sequentially during the air cooing the alloy article from the elevated temperature.

9. The process of claim 1, wherein the mechanical force comprises a force compressing the alloy article.

10. The process of claim 1, wherein the mechanical force comprises a force placing the alloy article in tension.

11. The process of claim 1, wherein the mechanical force is applied by roller leveling the alloy article beginning at the elevated temperature.

12. The process of claim 11, comprising roller leveling the alloy article with a single pass beginning at the elevated temperature.

13. The process of claim 11, comprising roller leveling the alloy article with multiple passes beginning at the elevated temperature.

14. The process of claim 1, wherein the mechanical force is applied by continuously applying a stretching force to the alloy article beginning at the elevated temperature.

15. The process of claim 1, wherein the mechanical force is applied by sequentially applying a stretching force to the alloy article beginning at the elevated temperature.

16. The process of claim 1, wherein the mechanical force is applied by placing the alloy article between two parallel faces of a platen press and applying a compressive force to the alloy article at the elevated temperature, and maintaining the compressive force on the alloy article during at least a portion of the air cooling of the alloy article from the elevated temperature.

17. The process of claim 16, comprising maintaining the compressive force on the alloy article continuously as the alloy article air cools from the elevated temperature.

18. The process of claim 16, wherein the compressive force is a constant compressive force beginning at the elevated temperature.

19. The process of claim 16, comprising maintaining the compressive force on the alloy article sequentially as the alloy article air cools from the elevated temperature.

20. The process of claim 1, wherein the alloy article comprises a geometric shape having a planar configuration, and further comprises an air-hardenable high-strength steel alloy.

21. The process of claim 1, wherein the alloy article is one of a plate and a sheet comprising an air-hardenable high-strength steel alloy.

22. The process of claim 1, wherein the alloy article comprises a thickness of 0.030 inches to 5.000 inches.

23. The process of claim 1, wherein the alloy article comprises a plate or sheet having a thickness of 0.030 inches to 2.000 inches, and wherein the alloy article comprises a steel alloy including, in weight percentages, 0.22-0.32 carbon, 3.50-4.00 nickel, 1.60-2.00 chromium, 0.22-0.37 molybdenum, 0.80-1.20 manganese, 0.25-0.45 silicon, 0-0.020 phosphorus, 0-0.005 sulfur, iron, and incidental impurities.

24. The process of claim 23, wherein the steel alloy consists of, in weight percentages, 0.22-0.32 carbon, 3.50-4.00 nickel, 1.60-2.00 chromium, 0.22-0.37 molybdenum, 0.80-1.20 manganese, 0.25-0.45 silicon, 0-0.020 phosphorus, 0-0.005 sulfur, incidental impurities, and balance iron.

25. The process of claim 1, wherein the alloy article comprises one of a plate and a sheet having a thickness of 0.030 inches to 2.000 inches, and wherein the alloy article comprises a steel alloy including, in weight percentages, 0.42-0.52 carbon, 3.75-4.25 nickel, 1.00-1.50 chromium, 0.22-0.37 molybdenum, 0.20-1.00 manganese, 0.20-0.50 silicon, 0-0.020 phosphorus, 0-0.005 sulfur, iron, and incidental elements.

26. The process of claim 1, wherein the steel alloy consists of, in weight percentages, 0.42-0.52 carbon, 3.75-4.25 nickel, 1.00-1.50 chromium, 0.22-0.37 molybdenum, 0.20-1.00 manganese, 0.20-0.50 silicon, 0-0.020 phosphorus, 0-0.005 sulfur, and incidental impurities, and balance iron.

27. The process of claim 1, wherein the applied mechanical force has a magnitude at least as great as a yield strength of the alloy article.

28. A process for reducing flatness deviations in air-hardenable high-strength steel articles selected from sheet and plate, the process comprising:

heating an air-hardenable high-strength steel article selected from a sheet and a plate to an elevated temperature;

applying mechanical force to the article at the elevated temperature, the mechanical force applied using an operation selected from the group consisting of a roller leveling operation, a stretch leveling operation, and a platen press leveling operation; and air cooling the article from the elevated temperature, wherein the mechanical force has a magnitude at least as great as a yield strength of the article, wherein the mechanical force is applied during at least a portion of the air cooling of the article from the elevated temperature, and wherein after the mechanical force is no longer applied to the article, the article has reduced flatness deviations relative to the article just prior to heating the article to the elevated temperature.

29. The process of claim 28, wherein the elevated temperature is at least as great as a martensitic transformation start temperature of the article.

30. The process of claim 28, wherein the air cooling the article from elevated temperature comprises cooling the article in an ambient air environment without forced air flow over the article.

31. The process of claim 28, wherein the air cooling the article from elevated temperature comprises cooling the article using a forced air flow over the article.

32. The process of claim 28, wherein the article is not liquid quenched.

33. The process of claim 28, wherein the article comprises one of a plate and a sheet having a thickness of 0.030 inches to 2.000 inches, and wherein the article comprises an alloy consisting of, in weight percentages, 0.22-0.32 carbon, 3.50-4.00 nickel, 1.60-2.00 chromium, 0.22-0.37 molybdenum, 0.80-1.20 manganese, 0.25-0.45 silicon, 0-0.020 phosphorus, 0-0.005 sulfur, incidental impurities, and balance iron.

34. The process of claim 28, wherein the article comprises one of a plate and a sheet having a thickness of 0.030 inches to 2.000 inches, and wherein the article comprises an alloy consisting of, in weight percentages, 0.42-0.52 carbon, 3.75-4.25 nickel, 1.00-1.50 chromium, 0.22-0.37 molybdenum, 0.20-1.00 manganese, 0.20-0.50 silicon, 0-0.020 phosphorus, 0-0.005 sulfur, incidental impurities, and balance iron.

* * * * *